United States Patent [19]

Clayton et al.

[11] 4,197,863

[45] Apr. 15, 1980

[54] TOBACCO SMOKE FILTER

[76] Inventors: Benjamin Clayton, 1621 Bank of the Southwest Bldg., Houston, Tex. 77002; Benjamin H. Thurman, Rte. 4, Culpeper, Va. 22701

[21] Appl. No.: 661,865

[22] Filed: Feb. 27, 1976

Related U.S. Application Data

[63] Continuation of Ser. No. 466,483, May 2, 1974, abandoned, which is a continuation-in-part of Ser. No. 346,278, Mar. 30, 1973, abandoned.

[51] Int. Cl.[2] ..... A24B 15/027

[52] U.S. Cl. ..... 131/10.7; 131/109; 131/266

[58] Field of Search ..... 131/10.5, 10.7, 10.9, 131/264, 266

[56] References Cited

U.S. PATENT DOCUMENTS

| | | | |
|---|---|---|---|
| 2,763,267 | 9/1956 | Muller | 131/264 |
| 3,094,450 | 6/1963 | Davidson | 131/10 R |
| 3,234,949 | 2/1966 | White et al. | 131/10.7 |
| 3,393,683 | 7/1968 | Saunders | 131/264 |
| 3,518,921 | 7/1970 | Muller | 131/10.7 |

FOREIGN PATENT DOCUMENTS

| | | | |
|---|---|---|---|
| 1094642 | 12/1967 | United Kingdom | 131/10.7 |

*Primary Examiner*—V. Millin

*Attorney, Agent, or Firm*—Bacon & Thomas

[57] ABSTRACT

A filter for removing harmful ingredients from tobacco smoke without unduly increasing the draw having as an essential component a filter rod composed throughout of cotton fibers with substantially all of the fibers extending circumferentially of the axis of the rod. This component is combined with at least one other component positioned rearwardly of the smoke outlet and of the filter rod and this other component may be either at least one disc composed of intertangled wood cellulose or pure cotton fibers or a section of a conventional filter rod composed of cellulose acetate fibers. If at least one disc is present, it may be positioned by sandwiching it between two filter rod sections composed of cellulose acetate fibers or between one such section and the filter rod composed of cotton fibers. The entire filter assembly is closely confined within an impervious shell.

15 Claims, 9 Drawing Figures

TOBACCO SMOKE FILTER

This is a continuation of application Ser. No. 466,483, filed May 2, 1974, now abandoned, which is in turn a continuation-in-part of application Ser. No. 346,278, filed Mar. 30, 1973 and now abandoned.

The present invention relates to a tobacco smoke filter and more particularly, to such a filter which will efficiently remove harmful ingredients, commonly referred to as nicotine and tars, from the smoke without increasing the draw to an objectionably high level.

The principal use contemplated for the present filter is in conjunction with a cigarette, but it is to be understood that it is of general application and can be employed with any type of smoking article, e.g. a pipe, cigar or cigarette or cigar holder.

Many types of filters have been proposed for decreasing the amount of the harmful ingredients of tobacco smoke reaching the smoker, but many of them are found wanting because of the fact that to be truly satisfactory, a filter must not only remove a high proportion of the harmful ingredients but must do this without unduly impeding the passage of the smoke so as to result in too high a draw. Another factor of primary importance is, of course, that the filter must be capable of inexpensive fabrication so as not to make too costly the smoking article with which it is used.

Cotton has been proposed and used as a filter for tobacco smoke, but it has not been successful commercially, primarily because of its imparting an unpleasant, objectionable taste or flavor to the smoke. This is confirmed, for example, by U.S. Pat. No. 2,916,777 of Crane et al.

It is a primary object of the present invention to provide a filter for tobacco smoke which employs cotton, which does not result in a smoke that has the inherent objectionable taste of cotton, but instead a pleasing yet definite tobacco flavor.

It is another object of the invention to provide a filter for tobacco smoke which will remove a high proportion of the nicotine and tars contained therein while affording a balanced, pleasing smoke that has a definite tobacco taste.

Another object of the invention is to provide a filter for tobacco smoke which will not unduly increase the draw.

Yet another object of the invention is to provide a filter for tobacco smoke which causes the smoke to be evenly distributed when passing through it without channeling.

A further object of the invention is to provide a highly efficient filter for tobacco smoke which is economically produced.

A more specific object of the invention is to provide a cigarette incorporating a filter which has all of the attributes detailed in the foregoing objects.

Other and further objects of the invention will be apparent from the following detailed description taken in conjunction with the drawings in which.

Figure 1:
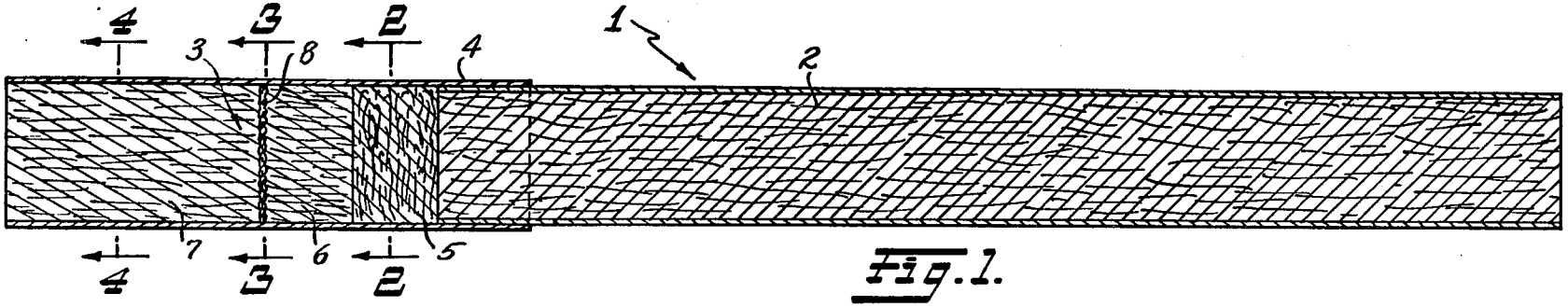
FIG. 1 is a longitudinal section illustrating a cigarette incorporating a filter which is a preferred embodiment of the invention.

It has unexpectedly been found that the objectionable taste of tobacco smoke caused by passing it through a filter composed of cotton fibers is removed by placing disc means composed of wood cellulose fibers in a filter assembly rearwardly of the portion composed of cotton so that the smoke must pass through the disc means after it has passed through the cotton and before it enters the smoker's mouth. In addition to its function of removing the objectionable cotton taste, the wood cellulose fiber disc means will itself remove significant amounts of the harmful ingredients of tobacco smoke.

Perhaps even more surprisingly, it has been found that disc means composed of wood cellulose fibers can be substituted by similar means composed of pure bleached cotton fibers, the nature of which means will be disclosed in detail hereinafter, without experiencing the unpleasant taste normally caused by a cotton filter for tobacco smoke. Further, it has been found that the disc means can be eliminated in its entirety, and the objects of the invention attained by a combination of the principal component composed of cotton fibers with a section of the conventional cellulose acetate filter rod of commerce positioned rearwardly of this principal component.

Thus, there is preserved the beneficial action of the cotton in removing nicotine and tars from the tobacco smoke to a significant extent, while overcoming the drawback of the objectionable taste which has heretofore prevented cotton filters from becoming commercially successful. Cotton also has the desirable property of absorbing moisture to an extent that it does not create a problem on subsequent condensation, as when the filter is employed in a pipe or cigar or cigarette holder.

The principal and essential cotton portion of the filter assembly according to the invention takes the form of a cylindrical rod or roll, and one particularly suitable product is readily available on the open market in the form of the so-called dental roll. One such product is manufactured and sold by Johnson and Johnson. These rolls are about five-sixteenths of an inch in diameter which is the approximate diameter of most cigarettes, and they may be incorporated in the filter assembly unchanged, except to cut them to the desired length.

The cotton rods or rolls are made from a carded fleece of cotton fibers which means that the individual fibers are orientated in the same general direction. The rods are formed by rolling the fleece upon itself in a manner that the finished rod is composed throughout of cotton fibers with substantially all of the fibers extending circumferentially of the axis of the rod. An adhesive is applied to the surface of the rod to maintain its shape.

The resultant product is an excellent filter for tobacco smoke, providing a multitude of paths through which the smoke must pass with channeling of the smoke being prevented.

One disc means which may be associated with the cotton fiber rod described above in the filter assembly according to the invention, which discs must be of high porosity so as not to increase the draw to an objectionable extent, are punched from sheets composed of randomly deposited and intertangled wood cellulose fibers. By "wood cellulose fibers" is meant cellulose fibers derived from the pulp of wood, itself, by being chemically separated from impurities, and in this type of disc, there is intended to be excluded other cellulose fibers of vegetable origin. Any wood cellulose sheet having the required porosity may be employed in the practice of the invention, but as illustrative, there may be mentioned the conventional paper towels and toilet tissues of commerce.

If the disc means is formed from the material of a paper towel, which is preferred, it has been found that a single disc will suffice for the purposes of the present invention. It is preferred that the paper towel be of the embossed type because this is believed to provide a greater surface area for contact by the tobacco smoke. Such paper towels have an air permeability of about 18 cubic feet/ min./ft.$^2$, and as examples of suitable commercial products, there may be mentioned Scott Paper Towel (embossed) and the Georgia Pacific "Coronet" paper towel (embossed).

As stated above, the sheets of intertangled wood cellulose fibers from which the disc means is formed may also comprise ordinary toilet tissue, which as is well known is highly absorbent and permeable to air. Such sheets are very thin ranging from about 0.002 to about 0.004 inches, usually about 0.003 inches, in thickness.

The air permeability or porosity of individual sheets of toilet tissue can vary considerably. For example, tests were carried out in accordance with ASTM test method D 737-69 on three commercially available brands of toilet tissue. Rocky Mountain, manufactured by the Fort Howard Paper Company of Green Bay, Wis., and Zodiac and Scott Tissue, both manufactured by the Scott Paper Company, Philadelphia, Pa., and the average air permeabilities were found to be respectively, 54,93 and 108 cubic feet/min./ft.$^2$. All of these tissues are suitable for the production of discs for use in filter assemblies of the present invention.

The number of wood cellulose discs formed from toilet tissue may vary considerably in accordance with their individual porosity and the amount of tars and nicotine to be removed from the tobacco smoke being filtered. Even a single disc has been found to effect a beneficial result. On the other hand, as many as seven discs have been successfully employed, but generally the optimum number of discs will range between three and five. In all instances, however, the discs will occupy only a very small fraction of the total length of the filter assembly of the invention.

When a plurality of wood cellulose fiber discs are employed, they may be produced simultaneously by a single punching from stacked sheets of tissue. It has been found that a plurality of discs so produced remain loosely adherent so that they can be handled easily as a unit for incorporation into the filter construction according to the invention.

The wood cellulose fiber disc or assembly of a plurality of discs may be positioned rearwardly of the smoke outlet end of the cotton filter rod generally transversely of its axis by any suitable means, but it is preferred that the disc be mounted in the filter assembly by sandwiching it between two sections of the conventional cellulose acetate tobacco smoke filter rods of commerce, such rods being fully described by U.S. Pat. No. 2,900,988 which issued on Aug. 25, 1959. Cellulose acetate fiber filter rods are relatively stiff in nature and provide excellent support for the very flexible discs, but the filter rod composed of cotton fibers, itself, is quite suitable to serve as one element of the "sandwich" with a length of cellulose acetate rod serving as the other. The cellulose acetate rods will also exert their own beneficial effect in removing harmful ingredients from the tobacco smoke, but this effect is inferior to that of the rod composed of cotton fibers.

The disc means composed of pure bleached cotton fibers which may be used in a filter assembly according to the invention in place of the wood cellulose fiber disc means described above is formed from a nonwoven fabric which is a highly air permeable felt composed of intermingled and frictionally interlocked cotton fibers of textile length, the fibers having artificially induced irregular kinks, twists, curls and bends to provide the frictional interlocking. Such felts are manufactured by the Kendall Company, Walpole, Mass., and sold under the trade name WEBRIL-R SERIES. They are composed of 100% pure bleached cotton fibers and utilize no binding agents. They have a weight of 72 to 260 grams per square yard, thus varying in thickness. One product particularly suitable for use in the production of a filter assembly according to the invention is WEBRIL-R 291 which has a thickness of about 0.085 inches and an air permeability of about 89.6 cubic feet/min/ft$^2$. These non-woven fabrics are prepared in the manner described in Canadian Pat. No. 521,659, issued Feb. 7, 1956. Because they have much greater porosity than the above-described discs composed of wood cellulose fibers, the total length of the filter assembly occupied by cotton fiber discs can be correspondingly greater.

As was the case with the disc means composed of wood cellulose fibers, the cotton fiber disc means may be positioned rearwardly of the cylindrical filter rod composed of cotton fibers by sandwiching it between this rod and a filter rod composed of cellulose acetate fibers or between two sections of the cellulose acetate filter rod. However, because the cotton fiber discs are considerably less flexible in nature, it is possible to form a filter assembly according to the invention by positioning these discs directly against the smoke outlet end of the filter rod composed of cotton fibers without any other support. It is preferred, however, in such an assembly, to ensure placement by abutting the smoke outlet end of the cotton fiber disc means with a ring of cardboard or other stiff material. As will be seen later in describing various embodiments of the invention in conjunction with the drawings, this can provide a recessed filter construction.

Disc means of the type described composed of pure bleached cotton fibers exert of themselves a pronounced beneficial effect in absorbing harmful ingredients from tobacco smoke and yet on subjective tests, there has not been noted the unpleasant taste normally present in smoke drawn through a cotton filter into the mouth of the smoker. Moreover this type of disc means has the ability to absorb moisture without the tendency towards clogging and increase in the draw which is sometimes observed in the case of disc means composed of wood cellulose fibers.

As was stated earlier, it has been found that disc means can be dispensed with entirely and still obtain a filter assembly for tobacco smoke which achieves the objects set forth for the present invention. This is accomplished by positioning rearwardly of the cylindrical filter rod composed of cotton filters only a section of the conventional filter rod composed of cellulose acetate fibers, the nature of which was fully described earlier. This means, of course, that there is sacrificed the considerable ability of the disc means to remove harmful ingredients from the smoke, but the principal and essential component of the present filter assembly is so efficient in this regard that truly remarkable results are still obtained.

The length of the entire filter assembly according to the invention will conveniently be that of the filter of the conventional filter cigarette, i.e. from 20 mm. to 25 mm. The length of the cotton filter rod portion of the filter assembly can vary quite widely in accordance with the proportion of the nicotine and tars it is desired to remove and the nature of the component with which it is combined. Lengths of 2 mm. to 15 mm. can be used with a length of about 5 mm., which weighs approximately 35 mg. being preferred when the cotton filter rod is combined with disc means composed of wood cellulose fibers. When a wood cellulose fiber disc means is employed, it will, of course, account for only a very minor proportion of the length of the filter assembly, and each disc will be punched so as to have a diameter equal to that of the cotton filter rod and the cellulose acetate filter rod, both of these rods having the same diameter. The cellulose acetate filter rod or rods will make up the remaining length of the entire filter assembly of the invention, and in the case of an assembly 20 mm. in length, this will, of course, be about 15 mm. in the preferred construction in which the cotton filter rod is approximately 5 mm. in length.

When disc means composed of pure bleached cotton fibers is used, its total length can be from about 1 mm. to about 11 mm., with a length of about 3 mm. being preferred in most instances, and the number of discs which may be present will, of course, vary in accordance with the thickness of the individual discs. The range set forth is suitable regardless of whether the disc means is associated only with the cotton filter rods or whether it is positioned in a sandwich construction involving the use of at least one cellulose acetate filter rod. In these constructions, the length of the cotton filter rod can be the same as that set forth above in connection with its combination with disc means composed of wood cellulose fibers.

This range for the length of the essential cotton filter rod component of the filter assembly also holds true when it is combined solely with a section of cellulose acetate filter rod. However, in this embodiment, in the case of a filter assembly having a total length of about 20 mm., it is preferred that the cotton rod constitute from about 5 mm. to 15 mm. of this length with a particularly preferred construction being one in which the cotton rod and cellulose acetate rod are of approximately the same length, that is to say each should have a length of about 10 mm.

The entire filter construction described above will be encased in a shell, such as one of a relatively stiff paper or cork sheet, to maintain a cylindrical shape. In the case of a cigarette, there will be employed a conventional tipping overwrap which extends beyond the filter assembly and secures it to the tobacco-filled section.

One embodiment of the invention is illustrated by FIGS. 1 through 4 of the drawings wherein there is shown a cigarette incorporating a filter assembly in which a disc composed of wood cellulose fibers and punched from an embossed paper towel is sandwiched between two filter rods composed of cellulose acetate filaments. As shown by FIG. 1, the cigarette generally designated by the numeral 1 comprises a tobacco-filled section 2 of conventional construction and a filter assembly 3. The filter assembly 3 is completely enclosed by a tipping overwrap 4 of relatively stiff material, such as the usual paper or cork sheet, the overwrap extending somewhat beyond the filter assembly and firmly engaging the tobacco-filled section to maintain them in assembled realtion.

The filter assembly 3 is constructed of a first length 5 of cotton filter rod, a second length 6 of cellulose acetate filter rod and a third length 7 of cellulose acetate filter rod. A wood cellulose fiber disc 8 formed from an embossed paper towel is sandwiched between the lengths 6 and 7 of cellulose acetate rod, the discs and rods being of equal diameter.

Figure 2:
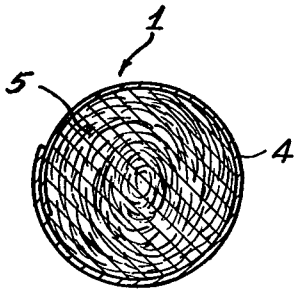
FIG. 2 is a cross-section taken on the line 2—2 of FIG. 1.
Figure 3:
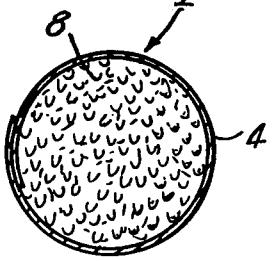
FIG. 3 is a cross-section taken on the line 3—3 of FIG. 1.
Figure 4:
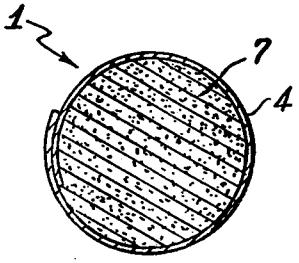
FIG. 4 is a cross-section taken on the line 4—4 of FIG. 1.

As stated above and shown in FIGS. 1 and 2, the length 5 of filter rod is composed throughout of cotton fibers with substantially all the fibers extending circumferentially of the axis of the rod. As also stated above and shown in FIGS. 1 and 4, the lengths 6 and 7 of filter rod are composed of cellulose acetate filaments which are continuous in nature and extend longitudinally of the cigarette in generally parallel relation, whereas, as is best shown in FIG. 3, the wood cellulose fibers of the disc 8 are much shorter in length and intertangled, lying generally in the same plane. The fibers of the disc 8 extend generally transversely of the axis of the cigarette and the disc occupies only a very small fraction of the total length of the filter assembly 3.

Figure 5:
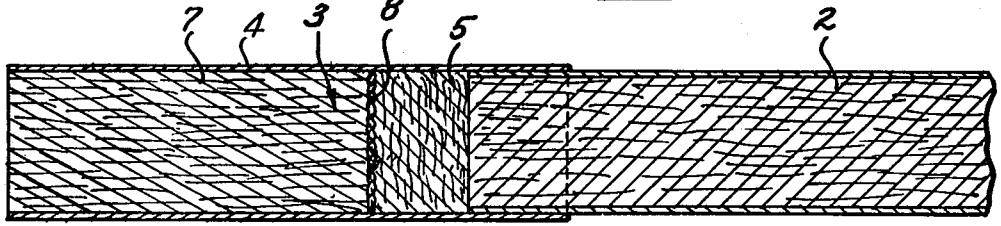
FIG. 5 is a longitudinal section illustrating a cigarette incorporating a modified embodiment of a filter according to the invention.

FIG. 5 of the drawings illustrates a modified embodiment of the invention wherein there is shown a cigarette incorporating a filter assembly in which a wood cellulose fiber disc is sandwiched between a cotton filter rod and a cellulose acetate filter rod. This is the only way that this embodiment differs from that described above and in the drawing corresponding elements have been numbered the same.

Figure 6:
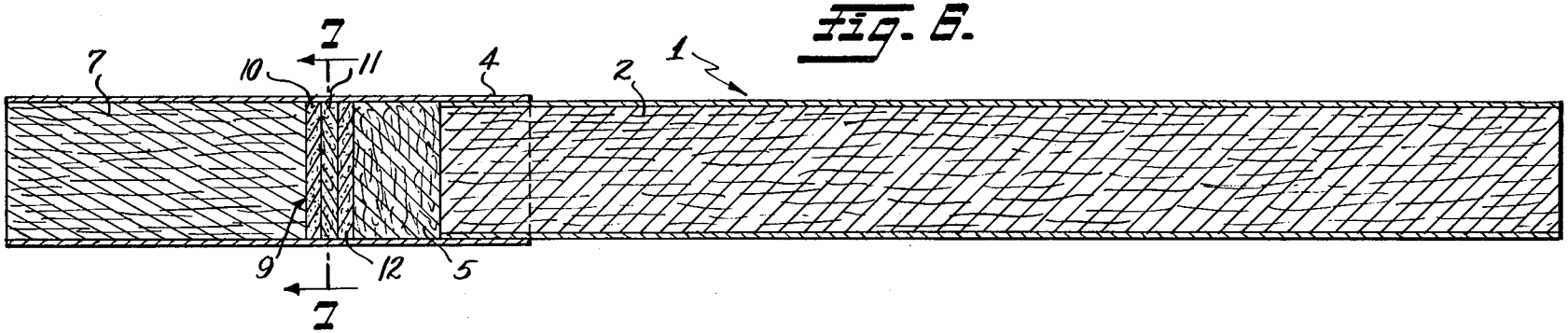
FIG. 6 is a longitudinal section illustrating a further embodiment of a filter according to the invention.

An embodiment of the invention using disc means composed of cotton fibers in the construction of the filter assembly is illustrated by FIG. 6 of the drawings. As shown, cotton fiber disc means generally designated by the numeral 9 comprises individual discs 10, 11 and 12 which abut each other and the length 5 of cotton filter rod. Disc means 9 is firmly maintained in position by sandwiching it between the length 5 of cotton filter rod and a length 7 of cellulose acetate filter rod.

Figure 7:
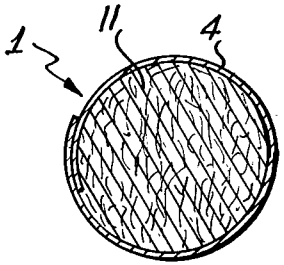
FIG. 7 is a cross-section taken on the line 7—7 of FIG. 6.

As is shown in FIG. 7, the cotton fibers of the discs are generally of textile length, the fibers having irregular kinks, twists, curls and bends to provide frictional interlocking.

Figure 8:
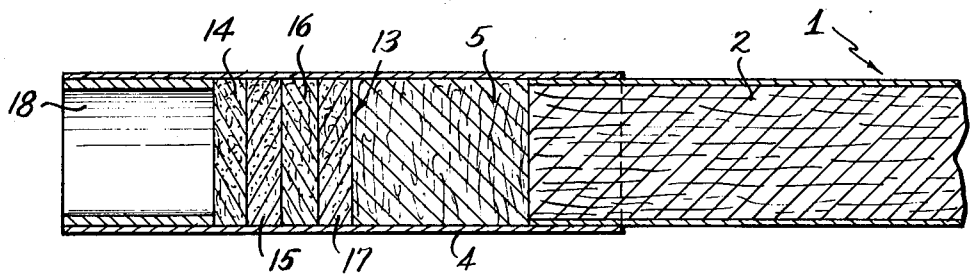
FIG. 8 is a longitudinal section illustrating another embodiment of a filter of the invention wherein the assembly is recessed.

FIG. 8 of the drawings illustrates a modified embodiment of the invention employing disc means composed of cotton fibers. In this embodiment the disc means generally designated by the numeral 13 comprises four individual discs 14, 15, 16 and 17 which differ from discs 10, 11 and 12 of the embodiment of FIG. 6 only in that they are somewhat thicker. The discs 14, 15, 16 and 17 abut against each other and against length 5 of cotton filter rod, and are maintained in position by an open cylindrical shell 18 formed of cardboard or other stiff material which co-terminates with the tipping overwrap 4 to provide a recessed filter construction.

Figure 9:
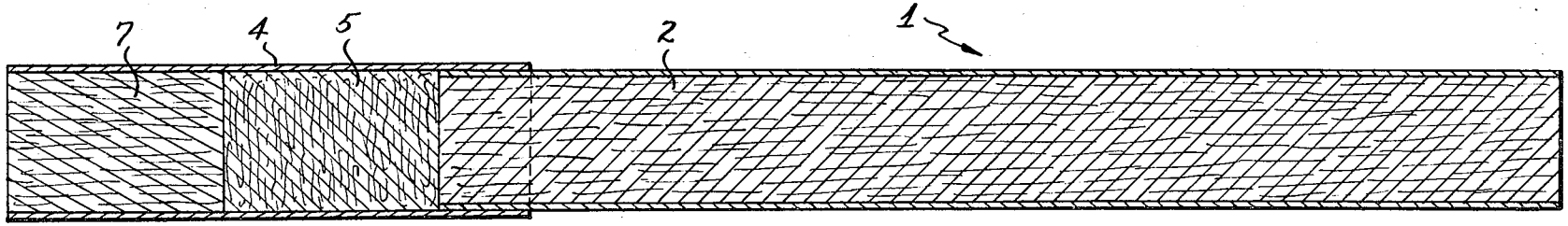
FIG. 9 is a longitudinal section illustrating still another embodiment of the invention.

FIG. 9 of the drawings illustrates an embodiment of the invention in which no disc means is present in the filter assembly. In this embodiment, the cellulose acetate filter rod 7 abuts the cotton filter rod 5, and, as is the case with the other embodiments described above, the filter assembly is secured to cigarette 1 by the tipping overwrap 4.

Tests were conducted to evaluate the efficiency of tobacco smoke filters according to the invention. These tests were conducted by inserting a non-filter Camel cigarette in one end of a plastic tube having an internal diameter equal to the external diameter of the cigarette. In a first test, the elements of the filter assembly described above in connection with the embodiment illustrated by FIGS. 1–4, except for the substitution of 5 discs of toilet tissue for the single disc of paper towel, were placed by hand in the plastic tube ahead of the cigarette. The length 5 of cotton filter rod was 5 mm., the length 6 of cellulose acetate filter was 5 mm. and the length 7 of cellulose acetate filter rod was 10 mm. The resulting assembly was smoked in a cigarette smoking machine of the type described by Bradford et.al. Ind. & Eng. Chem. 28, 836–839 (1936).

In accordance with the report of Dec. 31, 1971 of the laboratory of the Federal Trade Commission, a non-filter Camel cigarette has a total particulate matter content of 24.7 mg./cig. It was found that the total particulate matter of the specimen tested was 8.4 mg./cig. The draw compared favorably to that of filter cigarettes obtainable on the open market.

A second test was conducted in the same manner except that a disc punched from a paper towel (air permeability 18.2 cu.ft. per min. per sq.ft.) was substituted for the 5 discs of toilet tissue. The total particulate matter of this specimen was found to be 7.0 mg./cig., and the draw compared favorably to that of filter cigarettes obtainable on the open market.

A third test was conducted in the same manner in which the filter assembly starting from the mouth end consisted of a 10 mm. length of cellulose acetate rod, three cotton fiber discs each having a thickness of about 1 mm, a 5 mm. length of cellulose acetate filter rod and a 5 mm. length of cotton filter rod. The total particulate matter of the specimen tested was 7.3 mg./cig., and it had a satisfactory draw.

A fourth test was conducted in the same manner on a specimen which was the same as that which was the subject of the third test except that the length of the first section of cellulose acetate filter rod was 5 mm. and the length of cotton filter rod was 7.5 mm. The total particulate matter of this specimen was 8.2 mg./cig. and again it was found to have a satisfactory draw.

A fifth test was conducted in the same manner in which the filter assembly starting from the mouth end consisted of a 5 mm. length of cellulose acetate filter rod, five cotton fiber discs each having a thickness of about 2.2 mm. and a 5 mm. length of cotton filter rod. The total particulate matter of this specimen was 7.9 mg./cig. and it had a satisfactory draw.

A sixth test was conducted in the same manner in which the filter assembly which was recessed ¼ inch consisted from the mouth end of four cotton fiber discs each having a thickness of about 2.2 mm. and a 10 mm. length of cotton filter rod. The total particulate matter was found to be 8.1 mg./cig. and the specimen possessed a satisfactory draw.

A seventh test was conducted in the same manner in which the filter assembly starting from the mouth end consisted of a 10 mm. length of cellulose acetate filter rod and a 10 mm. length of cotton filter rod. The total particulate matter was found to be 9.3 mg./cig. and the draw was satisfactory.

An eighth test was conducted in the same manner on a specimen which was the same as that used in the seventh test except that the length of the cotton filter rod was 12.5 mm. The total particulate matter was found to be the same and no difference was detectable in the draw.

Smokers who smoked cigarettes identical to those smoked in the machine said the smoke was pleasing, and had a definite tobacco flavor and taste. The objectionable taste associated with cotton in a filter was absent.

Having described our invention, we claim:

1. A filter assembly for tobacco smoke, comprising a cylindrical filter rod having a smoke inlet end and a smoke outlet end and composed throughout of cotton fibers with substantially all said fibers extending circumferentially around the axis of said rod transversely thereof, in combination with porous non-perforated disc means positioned rearwardly of the smoke outlet end of said filter and having a diameter substantially equal thereto, said disc means being composed of randomly deposited and intertangled wood cellulose fibers or intermingled and frictionally interlocked cotton fibers of textile length; and a shell encasing said filter rod and component, said filter assembly possessing a good draw.

2. A filter assembly for tobacco smoke having a smoke inlet end and a smoke outlet end, comprising a first cylindrical section of filter rod at the smoke inlet end of said assembly composed throughout of cotton fibers with substantially all said fibers extending circumferentially around the axis of said rod transversely thereof, a second cylindrical section of filter rod composed of generally parallel cellulose acetate fibers, said second section being positioned rearwardly of said first section and adjacent thereto, a third cylindrical section of filter rod composed of generally parallel cellulose acetate fibers, thin porous non-perforated disc means composed of randomly deposited and intertangled wood cellulose fibers, said disc means having a diameter substantially equal to that of said filter rods and being sandwiched between said second and third sections, and a shell encasing said sections of filter rod and said disc means, said filter assembly possessing a good draw.

3. A filter assembly as claimed in claim 2 in which the disc means is formed of embossed paper.

4. A filter assembly as claimed in claim 2 in which said first and second sections are each about 5 mm. in length and said third section is about 15 mm. in length.

5. A filter assembly for tobacco smoke having a smoke inlet end and a smoke outlet end, comprising a first cylindrical section of filter rod at the smoke inlet end of said assembly composed throughout of cotton fibers with substantially all of said fibers extending circumferentially around the axis of said rod transversely thereof, a second cylindrical section of filter rod composed of generally parallel cellulose acetate fibers, said second section being positioned rearwardly of said first section, thin porous non-perforated disc means composed of randomly deposited and intertangled wood cellulose fibers, said disc means having a diameter substantially equal to that of said filter rods and being sandwiched between said first and second sections, and a shell encasing said sections of filter rod and said disc means, said filter assembly possessing a good draw.

6. A filter assembly as claimed in claim 5 in which the disc means is composed of embossed paper.

7. A filter assembly as claimed in claim 5 in which said first section is about 5 mm. in length and said second section is about 15 mm. in length.

8. A filter cigarette, comprising a tobacco-filled portion and a filter portion having a smoke inlet end and a smoke outlet end, said filter portion comprising a first cylindrical section of filter rod at the smoke inlet end of said filter portion composed throughout of cotton fibers with substantially all said fibers extending circumferentially around the axis of said rod transversely thereof, a second cylindrical section of filter rod composed of generally parallel cellulose acetate fibers, said second section being positioned rearwardly of said first section and adjacent thereto, a third cylindrical section of filter rod composed of generally parallel cellulose acetate fibers, and thin porous non-perforated disc means composed of randomly deposited and intertangled wood cellulose fibers, said disc means having a diameter substantially equal to that of said filter rods and being sandwiched between said second and third sections, and a tipping overwrap encasing said filter portion and extending therebeyond to engage said tobacco-filled portion, said cigarette possessing a good draw.

9. A filter cigarette, comprising a tobacco-filled portion and a filter portion having a smoke inlet end and a smoke outlet end, said filter portion comprising a first cylindrical section of filter rod at the inlet end of said filter portion composed throughout of cotton fibers with substantially all said fibers extending circumferentially around the axis of said rod transversely thereof, a second cylindrical section of filter rod composed of generally parallel cellulose acetate fibers, said second section being positioned rearwardly of said first section, and thin porous non-perforated disc means composed of randomly deposited and intertangled wood cellulose fibers, said disc means having a diameter substantially equal to that of said filter rods and being sandwiched between said first and second sections, and a tipping overwrap encasing said filter portion and extending therebeyond to engage said tobacco-filled portion, said cigarette possessing a good draw.

10. A filter assembly for tobacco smoke, comprising a cylindrical filter rod having a smoke inlet end and a smoke outlet end and composed throughout of cotton fibers with substantially all said fibers extending circumferentially around the axis of said rod transversely thereof, porous non-perforated disc means composed of intermingled and frictionally interlocked cotton fibers of textile length positioned rearwardly of the smoke outlet end of said filter rod generally transversely of its axis and having a diameter substantially equal thereto, and a shell encasing said filter rod and said disc means, said filter assembly possessing a good draw.

11. A filter assembly as claimed in claim 10 in which said disc means composed of cotton fibers is positioned by sandwiching it between sections of filter rod composed of generally parallel celiulose acetate fibers.

12. A filter assembly as claimed in claim 10 in which said disc means composed of cotton fibers is positioned by sandwiching it between said filter rod composed of cotton fibers and a section of filter rod composed of generally parallel cellulose acetate fibers.

13. A filter assembly as claimed in claim 10 in which said filter rod composed of cotton fibers has a length of from about 2 mm. to 15 mm. and said disc means composed of intermingled and frictionally interlocked cotton fibers has a total length of about 1 mm. to 11 mm.

14. A filter cigarette, comprising a tobacco-filled portion and a filter portion having a smoke inlet end and a smoke outlet end, said filter portion comprising a cylindrical section of filter rod at the smoke inlet end of said filter portion composed throughout of cotton fibers with substantially all said fibers extending circumferentially around the axis of said rod transversely thereof, porous non-perforated disc means composed of intermingled and frictionally interlocked cotton fibers of textile length positioned rearwardly of the smoke outlet end of said section of filter rod generally transversely of its axis and having a diameter substantially equal thereto, and a tipping overwrap encasing said filter portion and extending therebeyond to engage said tobacco-filled portion, said cigarette possessing a good draw.

15. A filter cigarette as claimed in claim 14 in which said filter portion consists of said cylindrical section of filter rod and said disc means composed of cotton fibers, said disc means being positioned against said filter rod by an open cylindrical shell of stiff material co-terminating with said tipping overwrap to form a recessed filter.

* * * * *